US008096858B2

(12) United States Patent
Sakamoto et al.

(10) Patent No.: US 8,096,858 B2
(45) Date of Patent: Jan. 17, 2012

(54) POLISHING PAD CONDITIONER

(75) Inventors: Hiroaki Sakamoto, Futtsu (JP); Toshiya Kinoshita, Tokyo (JP)

(73) Assignee: Nippon Steel Materials Co., Ltd., Tokyo (JP)

( * ) Notice: Subject to any disclaimer, the term of this patent is extended or adjusted under 35 U.S.C. 154(b) by 970 days.

(21) Appl. No.: 11/992,327

(22) PCT Filed: Aug. 17, 2006

(86) PCT No.: PCT/JP2006/316536

§ 371 (c)(1),
(2), (4) Date: Mar. 19, 2008

(87) PCT Pub. No.: WO2007/034646

PCT Pub. Date: Mar. 29, 2007

(65) Prior Publication Data

US 2009/0275274 A1 Nov. 5, 2009

(30) Foreign Application Priority Data

Sep. 22, 2005 (JP) ..... 2005-276376

(51) Int. Cl.
*B24B 21/18* (2006.01)

(52) U.S. Cl. ..... 451/443; 451/72; 451/444

(58) Field of Classification Search ..... 51/309; 451/56, 72, 443, 444
See application file for complete search history.

(56) References Cited

U.S. PATENT DOCUMENTS

| | | | | |
|---|---|---|---|---|
| 4,018,576 | A | 4/1977 | Lowder et al. | |
| 6,517,424 | B2 * | 2/2003 | Wielonski et al. | 451/443 |
| 7,258,708 | B2 * | 8/2007 | Sung | 51/307 |
| 2005/0202760 | A1 * | 9/2005 | Palmgren | 451/56 |
| 2006/0143991 | A1 * | 7/2006 | Sung | 51/307 |
| 2006/0213128 | A1 * | 9/2006 | Sung | 51/307 |

FOREIGN PATENT DOCUMENTS

| | | | |
|---|---|---|---|
| JP | 50-39661 | A | 4/1975 |
| JP | 62-34705 | | 2/1987 |
| JP | 03-131475 | | 6/1991 |
| JP | 9-108913 | A | 4/1997 |
| JP | 10-175156 | | 6/1998 |
| JP | 2001-287150 | A | 10/2001 |
| JP | 2002-521225 | A | 7/2002 |
| WO | WO 00/06340 | A | 2/2000 |

* cited by examiner

*Primary Examiner* — Timothy V Eley
(74) *Attorney, Agent, or Firm* — Kenyon & Kenyon LLP

(57) ABSTRACT

The invention provides a polishing pad conditioner that enables stabilization of brazing metal melting point, minimization of abrasive grain detachment by uniformizing and stabilizing abrasive grain brazing condition, and enhancement of flatness by minimizing thermal deformation of the metal support. The polishing pad conditioner is fabricated by brazing multiple abrasive grains to the surface of a metal support with brazing metal, wherein the composition of the brazing metal expressed in mass % is such that 70%≦Ni+Fe≦90% (provided that 0≦Fe/(Ni+Fe)≦0.4), 1%≦Cr≦25%, 2%≦Si+B≦15% (provided that 0≦B/(Si+B)≦0.8), and 0.1%≦P≦8%.

4 Claims, 2 Drawing Sheets

POLISHING PAD CONDITIONER

FIELD OF THE INVENTION

This invention relates to a polishing pad conditioner used to remove clogging substances and foreign matter from a polishing pad used in a chemical-mechanical planarization (CMP) process.

DESCRIPTION OF THE RELATED ART

CMP polishing is employed, for example, in machines for polishing semiconductor wafer surfaces, machines used in integrated circuit manufacture for surface planarization at the wiring and insulation layer formation stage, and machines for planarizing aluminium platters and glass platters utilized as hard disk substrates. In a typical method of CMP polishing, a urethane polishing pad is adhered to a rotating base plate and the rotating plate is pressed onto the surface to be polished while supplying a slurry containing fine abrasive grains thereto. The polishing performance of the polishing pad naturally declines with time in service. In order to mitigate the decline, the polishing pad is conditioned at regular time intervals by grinding off its surface region so as to keep a fresh surface constantly exposed. The unit that conducts the conditioning is called a "conditioner". It is fabricated by bonding abrasive grains to a metal substrate by electrodeposition, brazing or the like.

Brazing generally enables strong bonding of the abrasive grains because the brazing metal can be melted by increasing its temperature so as to make some elements of the abrasive grains chemically bond with some elements of the brazing metal. Japanese Patent Publication (A) No. S62-34705 teaches a tool that bonds an abrasive grain layer to a support using Pd—Cr—B—Ni type brazing metal. Japanese Patent Publication (A) No. H3-131475 teaches a brazing method using a brazing metal containing elements that readily form carbides, such as Fe, Mo and the like. Japanese Patent Publication (A) No. H10-175156 teaches a conditioner brazed using a brazing metal containing at least one of Ti, Zr and Cr.

SUMMARY OF THE INVENTION

As clear from the foregoing, brazing of abrasive grains to metal supports is done using brazing metals of various compositions suitable for the purpose at hand. However, at the time of heating the brazing metal to the melting point, it frequently happens, for example, that the brazing metal does not melt at its original melting point or that the brazing fails. A conventional practice has therefore been to improve the bonding performance of the abrasive grains by raising the brazing temperature. But this leads to a problem of heavy thermal deformation of the metal support owing to the high brazing temperature.

In view of the aforesaid issues, the present invention aims to provide a polishing pad conditioner that enables stabilization of brazing metal melting point, minimization of abrasive grain detachment by uniformizing and stabilizing abrasive grain brazing condition, and enhancement of flatness by minimizing thermal deformation of the metal support.

The polishing pad conditioner of the present invention is fabricated by brazing multiple abrasive grains to the surface of a metal support with brazing metal, wherein the composition of the brazing metal expressed in mass % is such that $70\% \leqq Ni+Fe \leqq 90\%$ (provided that $0 \leqq Fe/(Ni+Fe) \leqq 0.4$), $1\% \leqq Cr \leqq 25\%$, $2\% \leqq Si+B \leqq 15\%$ (provided that $0 \leqq B/(Si+B) \leqq 0.8$), and $0.1\% \leqq P \leqq 8\%$.

Another feature of the polishing pad conditioner of the present invention is that the abrasive grains are grains of at least one of diamond, cubic boron nitride, boron carbide, silicon carbide, and aluminum oxide and have a size in the range of 3 μm to 300 μm inclusive.

Another feature of the polishing pad conditioner of the present invention is that the metal support is made of stainless steel.

DETAILED DESCRIPTION OF THE PREFERRED EMBODIMENTS

Figure 1:
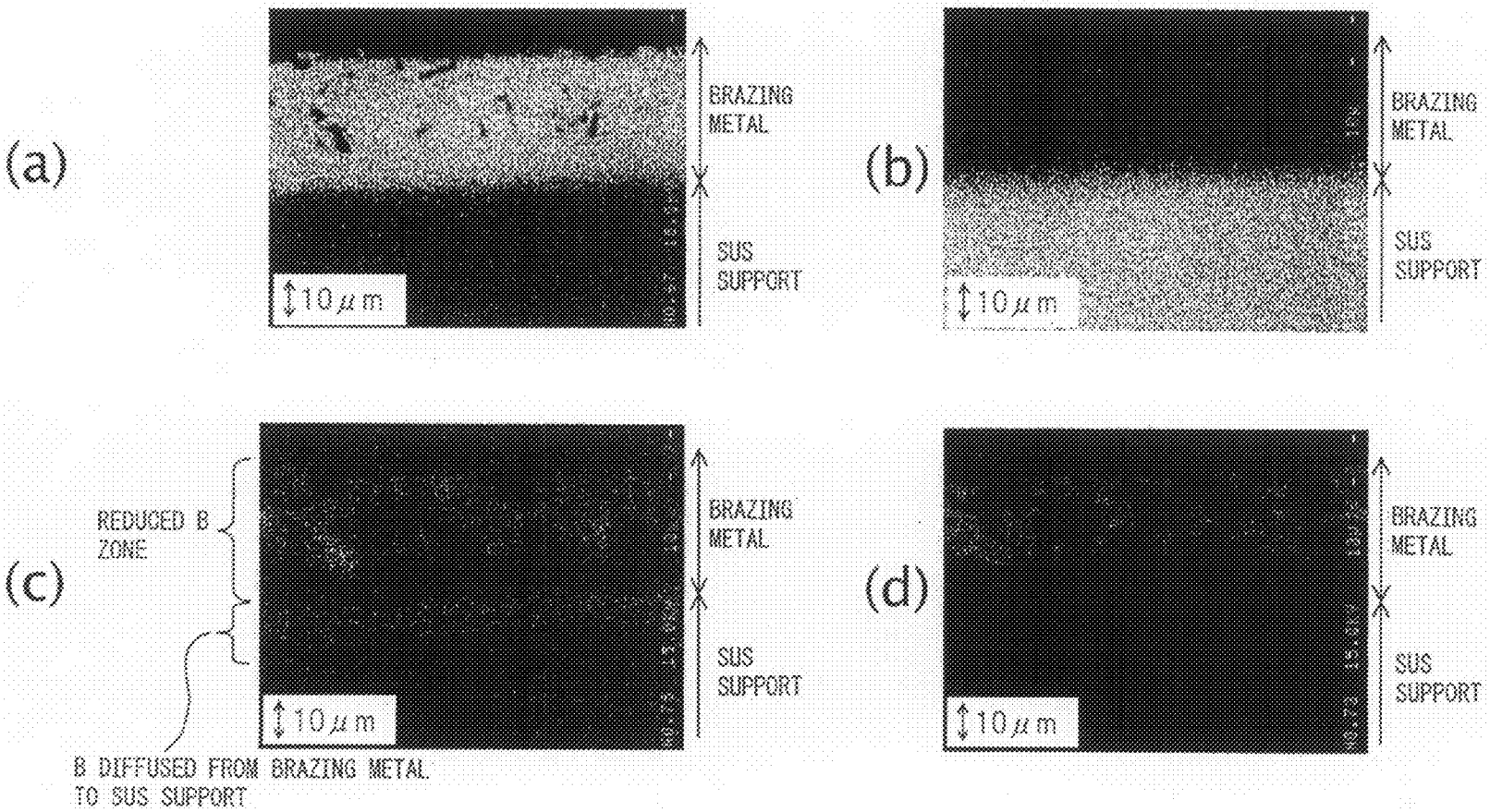
FIG. 1 is a set of images showing results of surface analysis of a polishing pad conditioner according to the present invention conducted using an electron probe micro-analyzer (EMPA), wherein (a) shows Ni distribution, (b) shows Fe distribution, (c) shows B distribution and (d) shows P distribution.

The inventors focused on the fact that in the case of brazing abrasive grains to a metal support with conventional brazing metal, when the thickness of foil brazing metal is varied, the applied thickness of powder brazing metal is varied or the brazing time is varied, it frequently happens that the brazing metal does not melt even when its temperature is raised to the melting point measured for the brazing metal independently, and that, even if it does melt, the viscosity thereof is high. In such instances, the bonding performance of the abrasive grains naturally declines. If the brazing temperature is raised to achieve good bonding performance, heavy thermal deformation of the metal support occurs, thereby degrading the flatness of the conditioner.

The inventors therefore thoroughly investigated the cause of the change in brazing metal melting point. They discovered that when Bni-2, Bni-5 and other typical JIS standard brazing metals of the Ni—Cr—Fe—Si—B type, Ni—Si—B type and Ni—Cr—Si—B type are used, abrasive grain bonding performance varies readily. In addition, they minutely analyzed cross-sections of samples obtained by brazing metal supports with brazing metal and found that B, a major component of brazing metal, was diffused from the brazing metal into the metal support, so that the amount of B remaining in the brazing metal became markedly less than the original B content of the brazing metal. An attempt to make up for the anticipated decrease in B content by increasing the B content beforehand would fail because the melting point of the brazing metal would increase to the point of making melting impossible. Moreover, the decrease in B content owing to diffusion was hard to control because it varied depending on the properties of the support material and the brazing temperature and time. Through studies based on this new knowledge, the inventors determined a brazing metal composition that ensures a stable melting point when the metal support and brazing metal are bonded by brazing. They realized the present invention as a result.

The present invention is characterized in that a predetermined amount of P is incorporated in a brazing metal having an Ni—Fe—Cr—Si—B type composition. A detailed investigation of various additive elements revealed that addition of P maintains the brazing metal melting point stable even when the metal support and brazing metal are bonded by brazing. A further investigation of P distribution in the zone straddling the brazing metal and metal support revealed that P, unlike B, does not diffuse into the metal support but stays in the brazing metal. The present invention therefore defines the optimum content ranges of Ni, Fe, Cr, Si and B of the brazing metal composition in the case of incorporating a predetermined amount of P as, in mass %, 70%≦Ni+Fe≦90% (provided that 0≦Fe/(Ni+Fe)≦0.4), 1%≦Cr≦25%, 2%≦Si+B≦15% (provided that 0≦B/(Si+B)≦0.8), and 0.1%≦P≦8%.

Ni is a major constituent element of the brazing metal. The brazing metal melting point rises at a total of Ni and Fe of less than 70 mass % or greater than 90 mass %, making it necessary to raise the brazing temperature, so that the likelihood of metal support warping by thermal deformation increases. The total is therefore defined in mass % as 70%≦Ni+Fe≦90%. No particular problem arises when Fe is not included in the brazing metal. However, when the metal support is made of stainless steel or similar material, inclusion of Fe in the brazing metal improves bonding performance between the brazing metal and the support owing to the presence of Fe in the support. When the ratio of Fe to (Ne+Fe) exceeds 0.4, the melting point rises and the brazing temperature has to be increased. The ratio is therefore defined as 0≦Fe/(Ni+Fe)≦0.4.

A CMP conditioner is ordinarily used under an acid or alkaline slurry. Cr is therefore incorporated in the brazing metal to increase its corrosion resistance. Sufficient corrosion resistance is not obtained at a Cr content of less than 1 mass % and no further improvement in corrosion resistance is observed when the content exceeds 25 mass %, so Cr content is defined in mass % as 1%≦Cr≦25%.

Si and B are added to lower the melting point of the brazing metal. When the total of Si and B is less than 2 mass % or greater than 15 mass % the decrease in melting point is inadequate, making it necessary to increase the brazing temperature. The total of Si and B is therefore defined in mass % as 2%≦Si+B≦15%. The brazing metal can take two forms: foil and powder. The foil form is generally obtained by, for example, the method of producing an amorphous foil using a single-roll quenching process. As B is an element required for amorphous formation, it is included at a content of 1 mass % or greater when foil brazing metal is produced. But the amorphous formation performance does not improve further when the ratio of B to (Si+B) goes above 0.8 and increasing it beyond this level tends to make the foil itself brittle. In the production of powder brazing metal, inclusion of B is not absolutely necessary provided that the desired melting point can be achieved. In view of these considerations, the ratio of B to the total of Si and B is defined as 0≦B/(Si+B)≦0.8).

The inventors focused on the element P that characterizes the present invention for its ability to stabilize the brazing metal melting point, namely, to eliminate the difference between the melting point measured for the brazing metal alone and the melting point measured for the brazing metal bonded to the metal support. P can stabilize the melting temperature unaffected by variation in brazing metal thickness, brazing temperature and brazing time. The brazing temperature, which has conventionally been set high to provide a margin of safety, can be set low to mitigate deformation of the metal support by heat. Further, the wettability between the abrasive grains and brazing metal is enhanced, so that bonding performance is stabilized and abrasive grain detachment minimized when the abrasive grains are brazed to the metal support. The melting point stabilizing effect cannot be obtained at a P content of less than 0.1 mass %. When the P content is greater than 8 mass %, the melting point stabilizes, but wettability with respect to the abrasive grains becomes great, so that in some cases the abrasive grains may become coated with brazing metal. P content is therefore defined in mass % as 0.1%≦P≦8%, preferably 0.1%≦P≦4%. Although the tendency for the abrasive grains to be coated with brazing metal increases with decreasing abrasive grain size, coating can be reliably prevented by defining the upper limit of P content as 4 mass %.

The abrasive grains used in the polishing pad conditioner of the present invention should have high hardness and react sparingly with the acid or alkaline slurry. In view of these requirements, the abrasive grains used in the present invention are grains containing at least one of diamond, cubic boron nitride, boron carbide, silicon carbide, and aluminum oxide. It is also possible to use any of such abrasive grains whose surfaces are coated with at least one member selected from among titanium, zirconium and chromium, or whose surfaces are coated with at least one member selected from among titanium carbide, zirconium carbide and chromium carbide. The different types of abrasive grains are usually used independently. However, use of a mixture of two or more types of abrasive grains of about the same size but exhibiting different polishing pad conditioning capability makes it possible to increase conditioning capability without increasing polishing pad roughness.

The size of the abrasive grains is preferably in the range of 3 μm to 300 μm inclusive. In a case where the polishing capability of the polishing pad after conditioning is a particular concern, abrasive grains measuring around 40-50 μm or greater are preferable. In a case where the flatness of the polishing pad after conditioning is a particular concern, abrasive grains measuring 40-50 μm or less are preferable. Use of the P-containing brazing metal of the present invention enables the bonding of abrasive grains of relatively small diameter on the order of 40-50 μm or less to be stably conducted. Bonding of abrasive grains of 40-50 μm or smaller diameter requires use of thin brazing metal. As pointed out earlier, the conventional brazing metal is in such cases frequently observed to experience a change in melting point that makes bonding impossible. In contrast, the brazing metal of the present invention enables bonding of even such small-diameter grains. The lower limit of abrasive grain size is defined as 3 μm because the polishing capability of the polishing pad after conditioning is insufficient at an abrasive grain size of less than 3 μm. When the abrasive grain size is greater than 300 μm, the roughness of the polishing pad increases to the point of hindering polishing and degrading the performance of the polishing pad. In light of the aforesaid considerations, the size of the abrasive grains is preferably in the range of 3 μm to 300 μm inclusive. A smaller abrasive grain size increases the difficulty of bonding from viewpoint of handling and other aspects. Therefore, insofar as no problem arises regarding the flatness of the polishing pad, it is preferable to use abrasive grains measuring around 10 μm or greater.

The thickness of the aforesaid brazing metal used in the present invention is preferably in the approximate range of 2 μm to 260 μm inclusive. This is because the thickness is preferably about the same as or less than the abrasive grain size. However, owing to the fact that the bonding of the metal support and the brazing metal itself becomes difficult when the brazing metal thickness is thin, a brazing metal thickness of around 10 μm or greater is more preferable.

The metal support is preferably made of stainless steel that, like the abrasive grains, reacts sparingly with the acid or alkaline slurry. Suitable for use are typical stainless steels such as those having the JIS designations SUS304, SUS316 and SUS430. Use of a metal support made of carbon steel or other ordinary structural steel whose surface is plated with Ni or the like is also possible.

The brazing metal used to fabricate the polishing pad conditioner of the present invention can be manufactured by a conventional method using an alloy of the composition defined by the present invention. It can be manufactured in foil form by the single roll method of ejecting melt from a slot nozzle onto a rotating cooling roll to from a foil. It can be manufactured in powder form by the gas atomizing method or the method of pulverizing an ingot using a ball mill or the like.

The polishing pad conditioner of the present invention can be obtained by using the invention brazing metal manufactured in such manner to bond abrasive grains onto a metal support by a conventional manufacturing method.

The conditioner according to the present invention is fabricated as explained hereinafter. First, the brazing metal is provisionally adhered to the metal support. When foil brazing metal is used, provisional attachment by spot welding is possible. When powder brazing metal is used, it suffices, for example, to coat the metal support with a blend of the powder and a binder such as cellulose. The abrasive grains need only be arranged on the brazing metal randomly or in a predetermined pattern such as in the vicinity of the corners of a rectangle or triangle. The abrasive grains are arranged in a single layer at a density of about 1 to 50,000 per square mm. At this time, the abrasive grains are provisionally attached with paste or the like to prevent shifting. Next, suction is applied using about $10^{-3}$ Pa negative pressure, whereafter the brazing metal is heated to a temperature at which it is molten. Most of the binder, paste or the like vaporizes as the temperature rises. The temperature for melting the brazing metal is preferably the lowest temperature possible at or above the brazing metal melting point. At the highest, it is preferably within the range of the liquidus temperature plus about 20° C. This is because a high temperature increases deformation of the metal support by heat. A holding time at the brazing temperature of around 5 to 30 minutes is adequate. Use of the brazing metal for constituting the conditioner of the present invention enables stable brazing at a low temperature.

A conditioner in accordance with the present invention was used to condition a foamed urethane pad under passage of water for 30 hours continuously and was then examined for detachment of conditioner abrasive grains. No detached abrasive grains were observed.

Embodiments

Embodiments of the present invention will now be explained with reference to various invention and comparative examples.

First Set of Examples

A mother alloy comprising, in mass %, Ni, Fe: 0.12%, Cr: 7.4%, Si: 4.0%, B: 3.0% and P: 0.5% (P-containing alloy) was produced by the melting method. The mother alloy was used to produce a foil of 20 μm thickness and 50 mm width by the single-roll quenching process. Specifically, the mother alloy was placed in a quartz crucible equipped with a 0.4 mm×50 mm slot nozzle and melted at 1300° C. in an argon atmosphere. The molten mother alloy was ejected from the slot nozzle onto a Cu cooling roll rotating at a peripheral velocity of 25 m/sec to afford a foil. The gap between the nozzle and the cooling roll was 0.20 mm. For comparison, an alloy comprising, in mass %, Ni, Fe: 3.33%, Cr: 7.2%, Si: 4.2% and B: 3.0% (P-free alloy) was similarly processed into a foil.

The foils were overlaid two each on the surfaces of respective SUS304 stainless steel disks of 50 mm diameter and 4 mm thickness and spot-welded to the disks. Diamond grains of 50 μm diameter were arranged on the sheet surfaces in a square pattern at a density of 20 grains/mm$^2$, whereafter brazing was conducted in vacuum at 1000° C. for 20 min to fabricate conditioners. The condition of the bonds between the stainless steel disks and the brazing metal was good, with no occurrence of repelling or other defects.

Evaluation after brazing was done by observing the brazing condition of the diamond grains. The condition was rated "Good" when at least 40% of the diamond grain volume was embedded in brazing metal and was rated "Poor" when less that 40% was embedded. The fabricated conditioners were used to condition foamed pads for 30 hours continuously and were then examined for detachment of diamond grains. The conditioning was conducted under a total load of 2.5 kg while passing pure water. The results are shown in Table 1.

The distribution of P and B in the P-containing brazing metal used to fabricate the polishing pad conditioner of the present invention and the distribution of B in the Comparative Example brazing metal were investigated by cutting specimens of the brazing metals and surface-analyzing their cross-sections using an EMPA (Electron Probe Micro-Analyzer). The analysis was performed for regions where no diamond grains were present. The results are shown in FIGS. 1(*a*) to 1(*d*) and FIGS. 2(*a*) to 2(*d*).

TABLE 1

| No. | Brazing condition | Number of detached diamond grains | Remark |
|---|---|---|---|
| 1 (P-containing alloy) | Good | 0 | Invention |
| 2(P-free alloy) | Poor | 9 | Comparative |

As can be seen from the results shown in Table 1, the use of the P-containing brazing metal to fabricate the polishing pad conditioner of the present invention helped to maintain a good brazed condition and eliminated diamond grain detachment.

Figure 2:
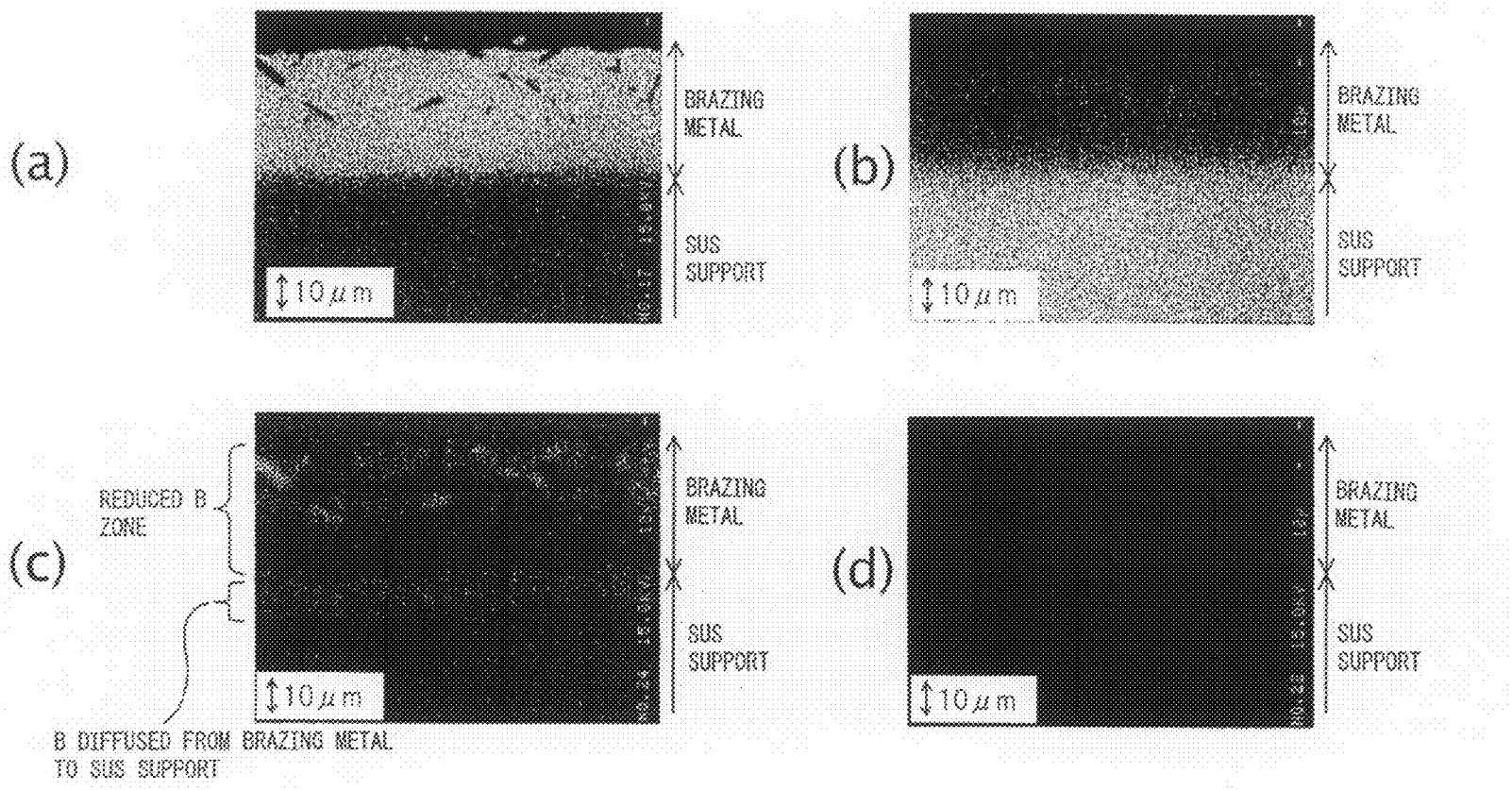
FIG. 2 is a set of images showing results of surface analysis of a polishing pad conditioner according to a comparative example conducted using an electron probe micro-analyzer (EMPA), wherein (a) shows Ni distribution, (b) shows Fe distribution, (c) shows B distribution and (d) shows P distribution.

Further, as can be seen from FIGS. 1(*c*) and 1(*d*) and FIGS. 2(*c*) and 2(*d*), the P-containing alloy and P-free alloy were both observed to experience diffusion of B from the brazing metal into the metal support. The concentration of B in the brazing metal therefore naturally declined. Such a decline in B concentration raises the brazing metal melting point. However, as can be seen in FIG. 1(*d*), the P in the P-containing alloy remained in the brazing metal. An actual investigation carried out by the inventors, showed that P and B have the same effect on melting point. Therefore, if a P-containing alloy is used as brazing metal, the presence of P inhibits melting point variation even if the B concentration of the brazing metal declines owing to diffusion of B into the stainless steel support.

Second Set of Examples

Mother alloys of the compositions shown in Table 2 were produced by the melting method. The mother alloys were used to produce foils of 20 μm thickness and 50 mm width by the single-roll quenching process. Specifically, each mother alloy was placed in a quartz crucible equipped with a 0.4 mm×50 mm slot nozzle and melted at 1300 to 1400° C. in an argon atmosphere. The molten mother alloy was ejected from the slot nozzle onto a Cu cooling roll rotating at a peripheral velocity of 25 m/sec to afford a foil. The gap between the nozzle and the cooling roll was 0.20 mm.

The foils prepared by the foregoing method were spot welded on the surfaces of respective SUS304 stainless steel disks of 50 mm diameter and 4 mm thickness. Diamond grains of 30 μm diameter were arranged on the sheet surfaces in a square pattern at a density of 40 grains/mm$^2$, whereafter brazing was conducted in vacuum at 980° C. for 15 min to fabricate conditioners. The condition of the bonds between the stainless steel disks and the brazing metal was good, with no occurrence of repelling or other defects.

Evaluation after brazing was done by observing the brazed state of the diamond grains. The condition was rated "Good" when at least 40% of the diamond grain volume was embedded in brazing metal and was rated "Poor" when less that 40% was embedded. A "Poor" rating was also assigned when the diamond grains were totally buried in the brazing metal. The fabricated conditioners were used to condition foamed pads for 30 hours continuously and were then examined for detachment of diamond grains. The conditioning was conducted under a total load of 2.5 kg while passing pure water. The results are shown in Table 2.

TABLE 2

| No. | Ni + Fe Mass % | Fe/(Ni + Fe) | Cr Mass % | Si + B Mass % | B/(Si + B) | P Mass % | Brazing condition | Number of detached diamond grains | Remark |
|---|---|---|---|---|---|---|---|---|---|
| 11 | 85.6 | 0.035 | 7.2 | 7.2 | 0.60 | 0 | Poor | 12 | Comparative |
| 12 | 85.25 | 0.040 | 7.4 | 7.3 | 0.61 | 0.05 | Poor | 10 | Comparative |
| 13 | 85.18 | 0.038 | 7.5 | 7.2 | 0.43 | 0.12 | Good | 0 | Invention |
| 14 | 84.84 | 0 | 7.2 | 7.5 | 0.42 | 0.46 | Good | 0 | Invention |
| 15 | 84.3 | 0.039 | 7.3 | 7.2 | 0.31 | 1.2 | Good | 0 | Invention |
| 16 | 82.3 | 0 | 7.6 | 7.3 | 0.16 | 2.8 | Good | 0 | Invention |
| 17 | 80.9 | 0.037 | 7.4 | 7.4 | 0.19 | 4.3 | Good | 0 | Invention |
| 18 | 78.8 | 0.041 | 7.2 | 7.3 | 0.25 | 6.7 | Good | 0 | Invention |
| 19 | 77.7 | 0.041 | 7.3 | 7.2 | 0.20 | 7.8 | Good | 0 | Invention |
| 20 | 76.7 | 0.037 | 7.1 | 7.8 | 0.31 | 8.4 | Poor | 0 | Comparative |

As can be seen from Table 2, No. 11 and No. 12 were poor in diamond grain brazing condition and therefore experienced diamond grain detachment after pad conditioning. In the case of No. 20, excessive wettability led to the diamond grains being almost totally covered with brazing metal. In such a condition, the conditioner could not exhibit any pad conditioning capability.

No. 13 to No. 19 utilized the brazing metal containing a predetermined amount of P that characterizes the conditioner of the present invention. In No. 13 to No. 16, 50 to 70% of the diamond grain volume was embedded, and in No. 17 to No. 19, in which the P content exceeded 4 mass %, 70 to 90% of the diamond grain volume was embedded. Owing to the good brazing condition in No. 13 to No. 19, no diamond grain detachment was observed in these conditioners.

The conditioners No. 11 and No. 12 were fabricated again with the brazing temperature raised to 1040° C. The re-fabricated conditioners were subjected to the same evaluation and were again found to be poor in diamond grain brazing condition. The number of detached diamond grains in the re-fabricated conditioners No. 11 and No. 12 were 10 and 9, respectively. The highest brazing temperature that could be used was 1040° C. because warping of the stainless steel disks became pronounced when the temperature was raised above this level.

Third Set of Examples

Mother alloys of the compositions shown in Table 3 were produced by the melting method. Similarly to in the Second Set of Examples, the mother alloys were used to produce foils of the respective compositions. The foils were 35 μm thick and 50 mm wide. The foils were spot welded on the surfaces of respective SUS304 stainless steel disks of 50 mm diameter and 4 mm thickness. Diamond grains of 50 μm diameter were arranged on the sheet surfaces in a square pattern at a density of 25 grains/mm$^2$, whereafter brazing was conducted in vacuum at 1040° C. for 15 min. The condition of the bonds between the stainless steel disks and the brazing metal was good, with no occurrence of repelling or other defects. Evaluation after brazing was done similarly as in the Second Set of Examples. The results are shown in Table 3.

TABLE 3

| No. | Ni + Fe Mass % | Fe/(Ni + Fe) | Cr Mass % | Si + B Mass % | B/(Si + B) | P Mass % | Brazing condition | Number of detached diamond grains | Remark |
|---|---|---|---|---|---|---|---|---|---|
| 21 | 69.2 | 0.046 | 16 | 14.4 | 0.28 | 0.4 | Poor | 6 | Comparative |
| 22 | 70.3 | 0.045 | 14.5 | 11.5 | 0.30 | 3.7 | Good | 0 | Invention |
| 23 | 73 | 0.044 | 13.3 | 10.8 | 0.32 | 2.9 | Good | 0 | Invention |
| 24 | 78 | 0.041 | 7.2 | 14.5 | 0.22 | 0.3 | Good | 0 | Invention |
| 25 | 80 | 0.040 | 7.2 | 12.2 | 0.29 | 0.6 | Good | 0 | Invention |
| 26 | 85 | 0.038 | 7.2 | 6.3 | 0.47 | 1.5 | Good | 0 | Invention |
| 27 | 88 | 0.036 | 6.2 | 3.8 | 0.61 | 2.0 | Good | 0 | Invention |
| 28 | 91 | 0.035 | 6.5 | 2.2 | 0.50 | 0.3 | Poor | 11 | Comparative |

As can be seen from Table 3, No. 21 and No. 28 were poor in diamond grain brazing condition and therefore experienced diamond grain detachment after pad conditioning.

No. 22 to No. 27 utilized the brazing metal containing a predetermined amount of (Ni+Fe) that characterizes the conditioner of the present invention. In these conditioners, 40% to 75% of the diamond grain volume was embedded. Owing to the good brazing condition, no diamond grain detachment was observed.

Fourth Set of Examples

Mother alloys of the compositions shown in Table 4 were produced by the melting method. Similarly to in the Second Set of Examples, the mother alloys were used to produce foils of the respective compositions. The foils were 20 μm thick and 50 mm wide. The foils were spot welded on the surfaces of respective SUS304 stainless steel disks of 50 mm diameter and 4 mm thickness. Diamond grains of 25 μm diameter were arranged on the sheet surfaces in a square pattern at a density of 40 grains/mm$^2$, whereafter brazing was conducted in vacuum at 1040° C. for 15 min. The condition of the bonds between the stainless steel disks and the brazing metal was good, with no occurrence of repelling or other defects. Evaluation after brazing was done similarly as in the Second Set of Examples. The results are shown in Table 4.

TABLE 4

| No. | Ni + Fe Mass % | Fe/(Ni + Fe) | Cr Mass % | Si + B Mass % | B/(Si + B) | P Mass % | Brazing condition | Number of detached diamond grains | Remark |
|---|---|---|---|---|---|---|---|---|---|
| 31 | 85.1 | 0 | 7.2 | 7.2 | 0.42 | 0.5 | Good | 0 | Invention |
| 32 | 85 | 0.18 | 7.2 | 7.2 | 0.46 | 0.6 | Good | 0 | Invention |
| 33 | 85.1 | 0.28 | 7.2 | 7.3 | 0.45 | 0.4 | Good | 0 | Invention |
| 34 | 83.3 | 0.39 | 7.2 | 8.0 | 0.48 | 1.5 | Good | 0 | Invention |
| 35 | 84.7 | 0.45 | 7.2 | 7.9 | 0.47 | 0.2 | Poor | 9 | Comparative |

As can be seen from Table 4, No. 35 was poor in diamond grain brazing condition and therefore experienced diamond grain detachment after pad conditioning.

No. 31 to No. 34 utilized the brazing metal of a predetermined Fe/(Ni+Fe) ratio that characterizes the conditioner of the present invention. In these conditioners, 55% to 75% of the diamond grain volume was embedded. Owing to the good brazing condition, no diamond grain detachment was observed.

Fifth Set of Examples

Mother alloys of the compositions shown in Table 5 were produced by the melting method. Similarly to in the Second Set of Examples, the mother alloys were used to produce foils of the respective compositions. The foils were 25 μm thick and 50 mm wide. The foils were spot welded on the surfaces of respective SUS304 stainless steel disks of 50 mm diameter and 4 mm thickness. Diamond grains of 30 μm diameter were arranged on the sheet surfaces in a square pattern at a density of 40 grains/mm$^2$, whereafter brazing was conducted in vacuum at 1040° C. for 15 min. The condition of the bonds between the stainless steel disks and the brazing metal was good, with no occurrence of repelling or other defects.

Evaluation after brazing was done similarly as in the Second Set of Examples. Moreover, after the evaluation, each conditioner was soaked for 24 hours in aqueous hydrogen peroxide, whereafter the region of the bonding interface between the diamond grains and the brazing metal was examined with a scanning electron microscope (SEM). The results are shown in Table 5.

As can be seen from Table 5, the brazing condition of the diamond grains after brazing was good in all instances, with 55% to 85% of the diamond grain volume being embedded, and no diamond grain detachment occurred. In the case of the No. 41 conditioner, however, the SEM examination after soaking for 24 hours in aqueous hydrogen peroxide revealed a number of places where diamond grains were clearly in a detached condition, as evidenced by the fact that brazing metal had melted out at the region in contact with the diamond grains.

In contrast, substantially no brazing metal melted out in the conditioners No. 42 to No. 52.

Sixth Set of Examples

Mother alloys of the compositions shown in Table 6 were produced by the melting method. Similarly to in the Second Set of Examples, the mother alloys were used to produce foils of the respective compositions. The foils were 30 μm thick and 50 mm wide. The foils were spot welded on the surfaces of respective SUS304 stainless steel disks of 50 mm diameter and 4 mm thickness. Diamond grains of 40 μm diameter were arranged on the sheet surfaces in a square pattern at a density of 30 grains/mm$^2$, whereafter brazing was conducted in vacuum at 1040° C. for 15 min. The condition of the bonds between the stainless steel disks and the brazing metal was good, with no occurrence of repelling or other defects. Evaluation after brazing was done similarly as in the Second Set of Examples. The results are shown in Table 6.

TABLE 5

| No. | Ni + Fe Mass % | Fe/(Ni + Fe) | Cr Mass % | Si + B Mass % | B/(Si + B) | P Mass % | Brazing condition | Number of detached diamond grains | Remark |
|---|---|---|---|---|---|---|---|---|---|
| 41 | 89.6 | 0.110 | 0.7 | 7.4 | 0.41 | 2.3 | Good | 0 | Comparative |
| 42 | 88.4 | 0.060 | 1.5 | 8.5 | 0.47 | 1.6 | Good | 0 | Invention |
| 43 | 87.5 | 0.070 | 3.6 | 8.0 | 0.48 | 0.9 | Good | 0 | Invention |
| 44 | 86.7 | 0.065 | 4.8 | 7.9 | 0.46 | 0.6 | Good | 0 | Invention |
| 45 | 83.1 | 0.250 | 7.8 | 7.6 | 0.51 | 1.5 | Good | 0 | Invention |
| 46 | 80.7 | 0.080 | 10.2 | 7.4 | 0.35 | 1.7 | Good | 0 | Invention |
| 47 | 75.2 | 0.090 | 16.3 | 7.1 | 0.37 | 1.4 | Good | 0 | Invention |
| 48 | 75.6 | 0.065 | 18.8 | 5.3 | 0.57 | 0.3 | Good | 0 | Invention |
| 49 | 70.5 | 0.059 | 21.6 | 7.1 | 0.38 | 0.8 | Good | 0 | Invention |
| 50 | 72.1 | 0.078 | 22.9 | 4.5 | 0.67 | 0.5 | Good | 0 | Invention |
| 51 | 72.1 | 0.055 | 23.8 | 3.8 | 0.71 | 0.3 | Good | 0 | Invention |
| 52 | 71.4 | 0.048 | 24.8 | 3.6 | 0.38 | 0.2 | Good | 0 | Invention |

TABLE 6

| No. | Ni + Fe Mass % | Fe/(Ni + Fe) | Cr Mass % | Si + B Mass % | B/(Si + B) | P Mass % | Brazing condition | Number of detached diamond grains | Remark |
|---|---|---|---|---|---|---|---|---|---|
| 61 | 88.1 | 0.046 | 7.2 | 1.7 | 0.80 | 3.0 | Poor | 12 | Comparative |
| 62 | 87.7 | 0.041 | 7.6 | 2.6 | 0.75 | 2.1 | Good | 0 | Invention |
| 63 | 86.7 | 0.038 | 7.3 | 4.5 | 0.70 | 1.5 | Good | 0 | Invention |
| 64 | 84.6 | 0 | 7.2 | 7.5 | 0.43 | 0.7 | Good | 0 | Invention |
| 65 | 82.6 | 0 | 7.1 | 9.8 | 0.36 | 0.5 | Good | 0 | Invention |
| 66 | 80.6 | 0.015 | 7.2 | 11.5 | 0.26 | 0.7 | Good | 0 | Invention |
| 67 | 78.0 | 0.023 | 7.2 | 14.4 | 0.20 | 0.4 | Good | 0 | Invention |
| 68 | 77.2 | 0.009 | 7.5 | 15.1 | 0.24 | 0.2 | Poor | 10 | Comparative |

As can be seen from Table 6, No. 61 and No. 68 were poor in diamond grain brazing condition and therefore experienced diamond grain detachment after pad conditioning.

No. 62 to No. 67 utilized the brazing metal containing a predetermined amount of (Si+B) that characterizes the conditioner of the present invention. In these conditioners, 55% to 75% of the diamond grain volume was embedded. Owing to the good brazing condition, no diamond grain detachment was observed.

Seventh Set of Examples

Mother alloys of the compositions shown in Table 7 were produced by the melting method. Similarly to in the Second Set of Examples, the mother alloys were used to produce foils of the respective compositions. The foils were 32 μm thick and 50 mm wide. The foils were spot welded on the surfaces of respective SUS304 stainless steel disks of 50 mm diameter and 4 mm thickness.

In No. 71, however, the foil could not be prepared in the same form as those of No. 72 to No. 76 because its B content was less than 1 mass %, namely 0.73 mass %. In the case of No. 71, therefore, brazing metal powder of a grain diameter of 150 μm or less was prepared by the gas atomizing method. The atomizer nozzle had a circular orifice of 0.3 mm diameter and argon was used as the inert gas. The brazing metal powder was wetted with ethanol to form a slurry and the slurry was evenly spread on the stainless steel disk. Prior to overlaying the diamond grains, one end of the applied slurry was heated treated in vacuum at 980° C. for 5 min to melt the brazing metal, and was then solidified. The thickness of the brazing metal was 30 μm.

Next, diamond grains of 50 μm diameter were arranged on the No. 71 to No. 76 brazing metals in a square pattern at a density of 25 grains/mm$^2$, whereafter brazing was conducted in vacuum at 980° C. for 15 min. The condition of the bonds between the stainless steel disks and the brazing metal was good, with no occurrence of repelling or other defects. Evaluation after brazing was done similarly as in the Second Set of Examples. The results are shown in Table 7.

As can be seen from Table 7, No. 76 was poor in diamond grain brazing condition and therefore experienced diamond grain detachment after pad conditioning.

No. 71 to No. 75 utilized the brazing metal of a predetermined B/(Si+B) ratio that characterizes the conditioner of the present invention. In these conditioners, 40% to 70% of the diamond grain volume was embedded. Owing to the good brazing condition, no diamond grain detachment was observed.

Eighth Set of Examples

Brazing metal foil sheets of the type prepared for No. 31 among the Fourth Set of Examples were spot welded on the surfaces of respective SUS304 stainless steel disks of 50 mm diameter and 4 mm thickness. The thickness of brazing metal was varied by varying the number of overlaid foil sheets up to a maximum of 13 sheets, at which number of sheets the brazing metal thickness was about 260 μm. On the other hand, 20 μm thick foil sheets were subjected to emery polishing to vary the brazing metal thickness down to a minimum of about 2 μm. As a result of such foil stacking and polishing, brazing metal thicknesses ranging from around 2 μm to around 260 μm were obtained. Diamond grains having diameters of 3 μm, 10 μm, 40 μm, 130 μm, 200 μm and 300 μm were scattered onto the surfaces of the brazing metals using sieves. Since no binder or the like was used, care was taken so that the diamond grains would not fall off the brazing metal surfaces. At this time, the aforesaid method was used to adjust the brazing metal thickness to between about 50% and 90% of the diamond grain diameter. Brazing was conducted at 980° C. for 15 min, and the brazing condition was then observed similarly as in the Second Set of Examples. The condition of the bonds between the stainless steel disks and the brazing metal was good, with no occurrence of repelling or other defects. The results are shown in Table 8.

TABLE 7

| No. | Ni + Fe Mass % | Fe/(Ni + Fe) | Cr Mass % | Si + B Mass % | B/(Si + B) | P Mass % | Brazing condition | Number of detached diamond grains | Remark |
|---|---|---|---|---|---|---|---|---|---|
| 71 | 80.8 | 0.026 | 7.3 | 7.3 | 0.10 | 4.6 | Good | 0 | Invention |
| 72 | 81.8 | 0.035 | 7.2 | 7.3 | 0.16 | 3.7 | Good | 0 | Invention |
| 73 | 83.0 | 0.018 | 7.2 | 7.2 | 0.52 | 2.6 | Good | 0 | Invention |
| 74 | 81.6 | 0.009 | 7.3 | 7.2 | 0.69 | 3.9 | Good | 0 | Invention |
| 75 | 81.3 | 0.045 | 7.6 | 7.0 | 0.78 | 4.1 | Good | 0 | Invention |
| 76 | 85.3 | 0.041 | 7.3 | 7.2 | 0.85 | 0.2 | Poor | 10 | Comparative |

TABLE 8

| No. | Diamond grain diameter (μm) | Brazing metal thickness (μm) | Brazing condition | Remark |
|---|---|---|---|---|
| 81 | 3 | 2 | Good | Invention |
| 82 | 10 | 7 | Good | Invention |
| 83 | 40 | 30 | Good | Invention |
| 84 | 130 | 80 | Good | Invention |
| 85 | 200 | 180 | Good | Invention |
| 86 | 300 | 260 | Good | Invention |

As can be seen from Table 8, the polishing pad conditioners of the present invention that utilized the foil of No. 31 exhibited good brazing condition with respect to diamond grains ranging in diameter from as small as 3 μm to as large as 300 μm. Diamond grains of 10 μm or larger diameter we found to be easier to handle than smaller ones.

The conditioners were used to condition pads similarly as in the Second Set of Examples and their conditioning capabilities were determined from the amount of reduction of pad thickness per unit time. All of the conditioners No. 81 to No. 86 exhibited ample conditioning capability. The conditioners No. 85 and No. 86 with large diameter diamond grains were particularly excellent in conditioning capability.

Ninth Set of Examples

Brazing metal foil sheets of the type prepared for No. 31 among the Fourth Set of Examples were overlaid two each on the surfaces of respective SUS304 stainless steel disks of 50 mm diameter and 4 mm thickness and spot welded in overlaid pairs. As abrasive grains were used 60 μm-diameter cubic boron nitride grains, 70 μm-diameter boron carbide grains, 70 μm-diameter silicon carbide grains, 55 μm-diameter aluminum oxide grains, and a mixture of equal amounts (in mass %) of the aforesaid boron carbide and silicon carbide grains. In each case, the abrasive grains were arranged on the sheet surfaces in a square pattern at a density of 20 grains/mm$^2$, whereafter brazing was conducted in vacuum at 1000° C. for 20 min. The condition of the bonds between the stainless steel disks and the brazing metal was good, with no occurrence of repelling or other defects. The brazing condition was observed similarly as in the Second Set of Examples. The results are shown in Table 9.

TABLE 9

| No. | Abrasive grains | Brazing condition | Remark |
|---|---|---|---|
| 91 | Cubic boron nitride | Good | Invention |
| 92 | Boron carbide | Good | Invention |
| 93 | Silicon carbide | Good | Invention |
| 94 | Aluminum oxide | Good | Invention |
| 95 | Boron carbide + Silicon carbide | Good | Invention |

As can be seen from Table 9, the conditioners No. 91 to No. 95 fabricated using abrasive grains of cubic boron nitride, boron carbide, silicon carbide, aluminum oxide grains, and a mixture of boron carbide and silicon carbide all exhibited good condition. In every conditioner, 45% to 75% of the abrasive grain volume was embedded in the brazing metal.

The conditioners were used to condition pads similarly as in the Second Set of Examples and their conditioning capabilities were determined from the amount of reduction of pad thickness per unit time. All of the conditioners No. 91 to No. 95 exhibited ample conditioning capability.

Tenth Set of Examples

The warps of the invention conditioner No. 1 and comparative example conditioner No. 2 (from the First Set of Examples) were measured. Warp was measured as the height difference between the center of the stainless steel disk and a point 5 mm inward of the periphery of the disk. The difference (warp) was found to be 28 μm in No. 1 and 31 μm in No. 2.

As No. 2 had experienced diamond grain detachment owing to poor brazing condition, conditioner fabrication was repeated under the same conditions as for No. 2 except that the brazing temperature was raised to 1060° C. (No. 101) and 1080° C. (No. 102), and the warps of the conditioners were measured in the same way. The condition of the bonds between the stainless steel disks and the brazing metal was good, with no occurrence of repelling or other defects. The results are shown in Table 10.

TABLE 10

| No. | Brazing temp. (° C.) | Brazing condition | Number of detached Diamond grains | Warp (μm) | Remark |
|---|---|---|---|---|---|
| 1 (from First Set of Examples) | 1000 | Good | 0 | 28 | Invention |
| 2 (from First Set of Examples) | 1000 | Poor | 9 | 31 | Comparative |
| 101 | 1060 | Good | 0 | 51 | Comparative |
| 102 | 1080 | Good | 0 | 54 | Comparative |

As can be seen from Table 10, the brazing condition of the diamond grains was good in No. 101 and No. 102. (Although not indicated in the table, 65% to 80% of the diamond grain volume was embedded.) Diamond detachment was therefore suppressed. However, marked warping occurred.

The foregoing description demonstrates that the utilization of P-containing brazing metal to fabricate the conditioner according to the present invention effectively reduces conditioner warping by enabling reduction of the brazing temperature.

Comparing the case where the warp is less than 50 μm with the case where it is 50 μm or greater, the former case is found to produce a pronounced effect of minimizing unsymmetrical wear and the like, thus improving pad thickness uniformity, even over prolonged pad conditioning.

INDUSTRIAL APPLICABILITY

In the present invention, the composition of the brazing metal expressed in mass % is such that 70%≦Ni+Fe≦90% (provided that 0≦Fe/(Ni+Fe)≦0.4), 1%≦Cr≦25%, 2%≦Si+B≦15% (provided that 0≦B/(Si+B)≦0.8), and 0.1%≦P≦8%. Use of the brazing metal of this composition to fabricate the invention polishing pad conditioner enables improved production yield because the bonding performance of the abrasive grains is stabilized at the time the numerous abrasive grains are brazed to the metal support. Moreover, the brazing metal substantially eliminates variation of the brazing metal melting temperature, so that the brazing temperature, which has conventionally been set high to provide a margin of safety, can be set low. This advantageously mitigates deformation of the metal support by heat. In addition, the stabilization of abrasive grain bonding performance prevents detachment of the abrasive grains during use.

What is claimed is:

1. A polishing pad conditioner comprising multiple abrasive grains brazed to a surface of a metal support with a brazing metal, wherein the composition of the brazing metal expressed in mass % is such that:

70%≦Ni+Fe≦90%, provided that 0≦Fe/(Ni+Fe)≦0.4,
1%≦Cr≦25%,
2%≦Si+B≦15%, provided that 0≦B/(Si+B)≦0.8, and
0.1%≦P≦8%.

2. The polishing pad conditioner according to claim 1, wherein the abrasive grains are grains of at least one of diamond, cubic boron nitride, boron carbide, silicon carbide, and aluminum oxide.

3. The polishing pad conditioner according to claim 1, wherein the abrasive grains have a size in the range of 3 μm to 300 μm inclusive.

4. The polishing pad conditioner according to claim 1, wherein the metal support is made of stainless steel.

* * * * *